US011819076B2

(12) United States Patent
Smith et al.

(10) Patent No.: US 11,819,076 B2
(45) Date of Patent: Nov. 21, 2023

(54) FABRIC MATERIAL THAT IS RESISTANT TO MOLTEN METALS

(71) Applicant: Elevate Textiles, Inc., Greensboro, NC (US)

(72) Inventors: Cevin Brent Smith, Greensboro, NC (US); William J. Dilanni, Kernersville, NC (US); Thomas F. Aubrey, Raeford, NC (US)

(73) Assignee: Elevate Textiles, Inc., Greensboro, NC (US)

( * ) Notice: Subject to any disclaimer, the term of this patent is extended or adjusted under 35 U.S.C. 154(b) by 0 days.

(21) Appl. No.: 17/405,559

(22) Filed: Aug. 18, 2021

(65) Prior Publication Data

US 2022/0053860 A1 Feb. 24, 2022

Related U.S. Application Data

(60) Provisional application No. 63/144,618, filed on Feb. 2, 2021, provisional application No. 63/067,365, filed on Aug. 19, 2020.

(51) Int. Cl.

| | |
|---|---|
| ***A41D 31/00*** | (2019.01) |
| ***A41D 31/08*** | (2019.01) |
| ***D03D 1/00*** | (2006.01) |
| ***D03D 15/208*** | (2021.01) |
| ***D03D 15/233*** | (2021.01) |

(Continued)

(52) U.S. Cl.

CPC ..... *A41D 31/085* (2019.02); *D03D 1/0035* (2013.01); *D03D 15/208* (2021.01); *D03D 15/233* (2021.01); *D03D 15/283* (2021.01); *D03D 15/47* (2021.01); *D03D 15/513* (2021.01);

(Continued)

(58) Field of Classification Search

CPC ..... A41D 31/085; A41D 2500/20; D03D 1/0035; D03D 15/208; D03D 15/233; D03D 15/283; D03D 15/47; D03D 15/513; D03D 15/217; D03D 15/225; D10B 2331/02;

(Continued)

(56) References Cited

U.S. PATENT DOCUMENTS

| | | | | |
|---|---|---|---|---|
| 4,447,242 A | | 5/1984 | Benisek | |
| 4,920,000 A | * | 4/1990 | Green | D02G 3/443 428/920 |

(Continued)

FOREIGN PATENT DOCUMENTS

| | | |
|---|---|---|
| AU | 2012208990 B2 | 8/2012 |
| AU | 2017203866 B2 | 6/2017 |

(Continued)

OTHER PUBLICATIONS https://woolmaven.com/124/what-is-staple-length-in-wool-why-it-matters; McClune; Mar. 2022; accessed Apr. 5, 2023 (Year: 2022).*

(Continued)

*Primary Examiner* — Robert H Muromoto, Jr.
(74) *Attorney, Agent, or Firm* — Dority & Manning, P.A.

(57) ABSTRACT

Fabrics and garments are disclosed that have dual protection against molten metal splashes and electrical arc flashes. The fabrics can be made from spun yarns containing an intimate blend of fibers. The fibers contained in each yarn can include wool fibers, flame resistant cellulose fibers, and nylon fibers. In one aspect, relatively long wool fibers are incorporated into the yarns.

20 Claims, 1 Drawing Sheet

(51) Int. Cl.
*D03D 15/47* (2021.01)
*D03D 15/513* (2021.01)
*D03D 15/283* (2021.01)
*D03D 15/20* (2021.01)

(52) U.S. Cl.
CPC ..... *A41D 2500/20* (2013.01); *D10B 2331/02* (2013.01); *D10B 2501/04* (2013.01)

(58) Field of Classification Search
CPC ..... D10B 2501/04; D10B 2201/00; D10B 2211/02; D02G 3/443
See application file for complete search history.

(56) References Cited

U.S. PATENT DOCUMENTS

| | | | | |
|---|---|---|---|---|
| 8,209,785 | B2 * | 7/2012 | Underwood | D02G 3/047 2/458 |
| 8,528,120 | B2 * | 9/2013 | Underwood | D03D 15/513 2/458 |
| 8,793,814 | B1 * | 8/2014 | Dilanni | D03D 13/004 2/97 |
| 9,683,315 | B2 * | 6/2017 | Schmitt | D02G 3/443 |
| 10,030,326 | B2 | 7/2018 | Hines, Jr. et al. | |
| 10,167,137 | B2 | 1/2019 | Alexander et al. | |
| 10,316,440 | B2 * | 6/2019 | Stanhope | D03D 15/513 |
| 10,487,424 | B2 | 11/2019 | Stanhope et al. | |
| 10,870,932 | B2 * | 12/2020 | Stanhope | D03D 15/225 |
| 2004/0001978 | A1 | 1/2004 | Bader et al. | |
| 2005/0147815 | A1 | 7/2005 | Perrotto et al. | |
| 2008/0299854 | A1 * | 12/2008 | Hilleary | D04B 21/16 442/314 |
| 2011/0177740 | A1 * | 7/2011 | Waxman | D02G 3/443 442/302 |
| 2012/0278979 | A1 * | 11/2012 | Underwood | D02G 3/047 2/455 |
| 2013/0055490 | A1 | 3/2013 | Zhu | |
| 2013/0212790 | A1 * | 8/2013 | Waxman | D04B 1/14 428/221 |
| 2014/0187113 | A1 | 7/2014 | Hines, Jr. et al. | |
| 2014/0208491 | A1 * | 7/2014 | Schmitt | A41D 31/08 57/208 |
| 2016/0237594 | A1 | 8/2016 | Rock et al. | |
| 2017/0175302 | A1 | 6/2017 | Habicht et al. | |
| 2017/0254000 | A1 * | 9/2017 | Schmitt | D02G 3/443 |
| 2018/0030627 | A1 * | 2/2018 | Stanhope | D03D 15/513 |
| 2018/0127899 | A1 | 5/2018 | Tutterow et al. | |
| 2019/0153663 | A1 * | 5/2019 | Topalovic Jocic | A62B 17/003 |
| 2019/0242038 | A1 * | 8/2019 | Stanhope | D03D 1/0035 |
| 2019/0343204 | A1 * | 11/2019 | Li | D03D 15/513 |
| 2022/0053860 | A1 * | 2/2022 | Smith | D03D 15/283 |

FOREIGN PATENT DOCUMENTS

| | | | |
|---|---|---|---|
| CA | 2881104 | A1 | 2/2014 |
| CN | 101397710 | | 4/2009 |
| CN | 101397710 | A | 4/2009 |
| CN | 102199829 | A | 9/2011 |
| CN | 105109138 | A | 12/2015 |
| CN | 109797474 | A | 5/2019 |
| CN | 107574521 | B | 6/2019 |
| EP | 3061864 | A1 | 8/2016 |
| EP | 3061864 | A1 | 8/2016 |
| EP | 2877620 | B1 | 5/2019 |
| EP | 3037574 | B1 | 5/2019 |
| GB | 2470567 | A | 12/2010 |
| GB | 2470567 | A | 12/2010 |
| RU | 2001176 | C1 | 10/1996 |
| RU | 2001176 | C1 | 10/1997 |
| WO | WO2004/002254 | A1 | 1/2004 |
| WO | WO2014/167360 | A2 | 10/2014 |

OTHER PUBLICATIONS http://www.sheep101.info/201/woolmarketing.html; Schoenian; 2021; accessed Apr. 5, 2023 (Year: 2021).*

International Search Report Corresponding to Application No. PCT/US2021/046239 dated Dec. 9, 2021.

* cited by examiner

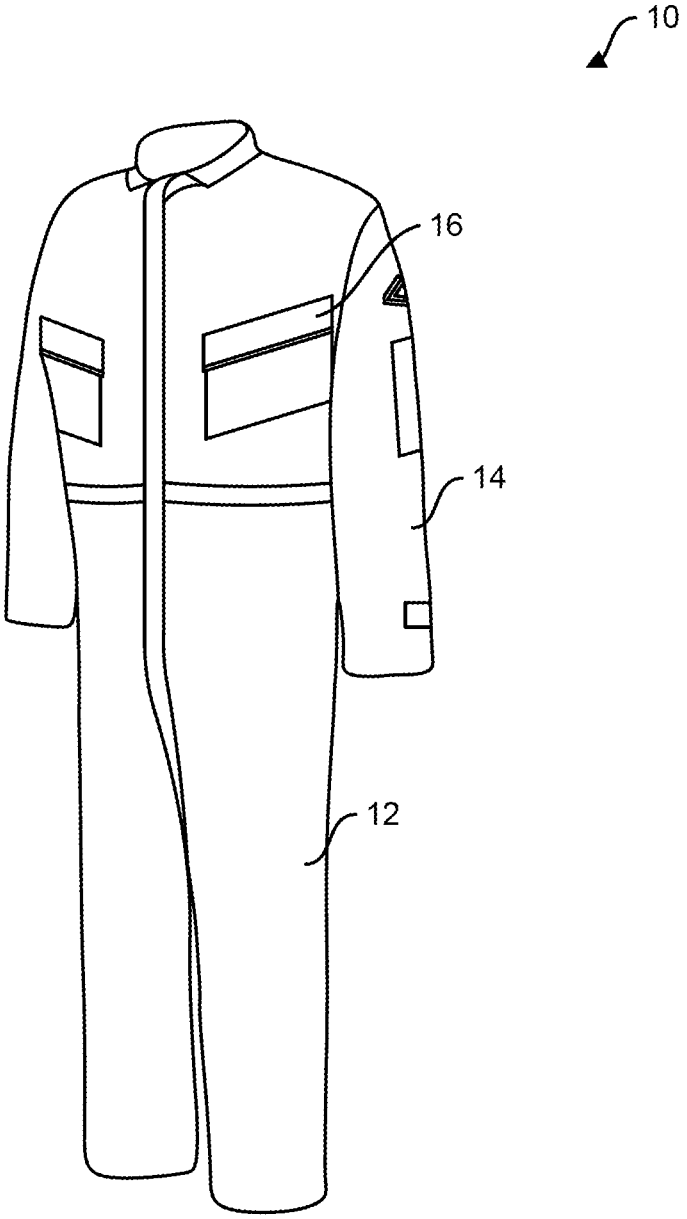
10
16
14
12

FABRIC MATERIAL THAT IS RESISTANT TO MOLTEN METALS

RELATED APPLICATIONS BACKGROUND

The present application is based on, and claims priority to, U.S. Provisional Patent Application Ser. Nos. 63/067,365 filed Aug. 19, 2020 and 63/144,618 filed Feb. 2, 2021, which are incorporated herein by reference.

BACKGROUND

Workers in many industrial settings and in various other occupations can be exposed to hazardous and life threating situations. For example, some workers operate in environments where there is a possibility that they will be exposed to molten metals or electrical arc flashes. For example, workers in metal processing or metal forming plants face the risk of exposure to molten metal splashes. As an example, iron foundry workers may be exposed to molten iron and workers in aluminum manufacturing plants can be exposed to molten aluminum and/or cryolite, and the like. In addition, welders are routinely exposed to welding slugs and/or molten metal drops. Welders are present in almost all industrial facilities and in smaller business settings.

In addition to molten metals, many workers can also be exposed to electrical arc flashes and/or open flames and fires. For example, almost every industrial or manufacturing facility employs electricians to make changes or modify the existing electrical system, to make repairs and/or to change out electrical components. During these operations and procedures, the workers face inherent dangers in working with the electrical lines and the power supply.

To avoid being injured while working in the environments as described above, workers and other personnel should be provided protective apparel that is capable of protecting the worker against the hazards that they may face, including molten metal spills or splashes, electrical arcs, open flames, and fires. These protective garments can take various forms including full body suits, pants, shirts, aprons, gloves, and the like. Ideally, the protective garment should possess life-saving properties for protecting the wearer should any accidental exposure occur. For example, garments designed to protect workers from molten metal spills and splashes should be made from materials that do not ignite when contacted with molten metals and should allow molten metals to shed or slide off the surface of the material without igniting. Similarly, protective garments designed to protect workers from arc flashes should be capable of being exposed to the arc flash without igniting or allowing the arc flash to propagate through the material.

In the past, various different fabrics have been proposed for producing garments and apparel that will protect workers from molten metal splashes, electrical arc flashes, and the like. Most conventional fabrics, for instance, are very heavy and thick, essentially relying on having enough fabric material between the worker and the hazardous condition to prevent injury. Although capable of protecting workers, these fabrics can cause other problems. For instance, the fabrics add a significant amount of weight to the wearer and typically do not have very good moisture management properties. Thus, workers can become stressed and undergo physical fatigue when wearing garments or apparels made from the fabric.

In the past, those skilled in the art have attempted to produce lighter fabrics that provide protection against molten metal splashes and electrical arc flashes. These fabrics, however, typically included a fiber blend and weaving structure that cause the fabric to have different properties in different directions. For instance, fabrics have been proposed having different physical properties in the warp direction as opposed to the fill direction. These differences can lead to dimensional stability problems, especially when wetted or soaked with water.

In view of the above, a need currently exists for an improved fabric that is resistant to molten metals and/or electrical arc flashes that not only offers significant protection to the wearer but is also dimensionally stable. A need also exists for a lightweight fabric that can provide dual protection against both molten metal spills and electrical arc flashes. A need also exists for apparel and garments made from a fabric as described above.

SUMMARY

In general, the present disclosure is directed to a fabric made from a blend of fibers that can provide protection against molten metal splashes and/or electrical arc flashes while remaining relatively lightweight. Of particular advantage, the fabric can be made from natural flame-resistant fibers such as wool combined with regenerated cellulose fibers, such as rayon which not only provides significant protection to the wearer but also greatly improves comfort and wearability, especially in industrial environments that are not temperature controlled. In one aspect, the fabric can be made from yarns that are the same or substantially the same in both the warp and fill direction providing the fabric with a great balance of physical properties in both directions and dimensional stability. The fabric of the present disclosure can be used to make all different types of garments and apparel.

In one embodiment, for instance, the present disclosure is directed to a garment that is resistant to molten metal splashes and/or electrical arc flashes. The garment includes a fabric shaped to cover at least a portion of a wearer's body. The fabric comprises a woven fabric made from a plurality of yarns. The fabric comprises warp yarns and fill yarns. The warp yarns and fill yarns comprise a fiber blended yarn. The fiber blended yarn comprises a blend of fibers including wool fibers in an amount of from about 22% to about 43% by weight, such as in an amount of from about 25% to about 40% by weight of the fabric; flame resistant cellulose fibers present in the fabric in an amount of from about 52% to about 82% by weight, such as in an amount of from about 55% to about 65% by weight; and non-aromatic polyamide fibers present in the fabric in an amount of from about 6% to about 14% by weight, such as in an amount of from about 8% to about 12% by weight. The yarns contained within the woven fabric can be made from an intimate blend of the wool fibers, the flame resistant cellulose fibers, and the non-aromatic polyamide fibers. The flame resistant cellulose fibers may comprise cotton or rayon fibers pretreated with a fire resistant composition.

The woven fabric can have a basis weight of from about 8 osy to about 14 osy, such as from about 10 osy to about 12 osy. The yarns can be two ply yarns. The fabric can made exclusively from the fiber blended yarns. In one aspect, the fabric comprises from about 70 yarns per inch to about 110 yarns per inch in the warp direction and about 45 yarns per inch to about 85 yarns per inch in the fill direction.

In one aspect, longer wool fibers can be used to improve and increase durability. The wool fibers, for instance, can comprise wool staple fibers having an average fiber length of greater than about 3 inches and less than about 5 inches. The cellulose fibers, in one aspect can comprise rayon staple fibers having an average fiber length of greater than about 3 inches and less than about 6 inches. Similarly, the non-aromatic polyamide fibers can comprise staple fibers having an average fiber length of greater than about 3 inches and less than about 6 inches.

Garments made in accordance with the present disclosure include shirts, overalls, trousers, aprons, and the like.

The present disclosure is also directed to a fabric material as described above that is used to construct the garment.

Garments and fabric materials made according to the present disclosure have an excellent balance of properties. In one aspect, the fabric material can be both resistant to molten metals splashes and resistant to arc flashes.

Other features and aspects of the present disclosure are discussed in greater detail below.

BRIEF DESCRIPTION OF THE DRAWINGS

A full and enabling disclosure of the present disclosure is set forth more particularly in the remainder of the specification, including reference to the accompanying figures, in which:

FIG. 1 is one embodiment of a garment made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only and is not intended as limiting the broader aspects of the present disclosure.

In general, the present disclosure is directed to a fabric and apparel made from the fabric that are resistant to molten metal splashes and/or arc flashes. The fabric of the present disclosure generally comprises a wool blended fabric. The wool blended fabric can be incorporated into all different types of protective apparel including shirts, pants, coveralls, coats, aprons, gloves, hoods, and the like.

In one aspect, the fabric of the present disclosure can be designed to protect not only against molten metal splashes but also against electrical arc flash exposure. For example, many workers operate in environments where possible exposure to molten metal splashes and possible exposure to electrical arc flashes are both present. Alternatively, workers may move in between manufacturing areas and thus can be exposed to both of the above hazards. Changing garments during a workday based on possible hazards present can be inconvenient and not feasible. The fabric of the present disclosure can provide dual hazard protection economically and at relatively low basis weights.

In addition to providing dual protection against molten metal splashes and electrical arc flashes, the fabric of the present disclosure offers many benefits and advantages. As described above, the fabric is generally made from a wool blend. More particularly, the fabric is made from yarns that each contain an intimate blend of fibers including wool fibers, polyamide fibers, and flame resistant cellulose fibers. The yarns made from the intimate blend have been found to be well suited for use as not only the warp yarns but also the fill yarns of a woven fabric. By having similar yarns in the warp and fill direction, fabrics made according to the present disclosure have an excellent balance of properties. For example, the fabric can have comparable physical properties, such as strength properties, in both directions which provide the fabric with dimensional stability. The dimensional stability characteristics of the fabric of the present disclosure are particularly evident when the fabric becomes wet. Conventional fabrics in which either the yarns are different in different directions and/or the fabric is anisotropic, for example, have a tendency to loose strength in one direction when wet.

The fabric of the present disclosure can also be formed with relatively long fibers. The longer fibers can provide greater strength. Longer fibers can also improve durability, decrease pilling, and increase abrasion resistance.

As described above, the fabric of the present disclosure is formed from spun yarns that contain a particular blend of fibers. More particularly, the blend of fibers include wool fibers combined with cellulose fibers such as flame resistant cellulose fibers and polyamide fibers, particularly nylon fibers. The spun yarns incorporated into the fabric can be single spun yarns or can be plied yarns, such as two ply yarns. Alternatively, the fabric can contain both single spun yarns and plied yarns. In one aspect, the fabric contains plied yarns in at least one direction, such as in the warp direction, the fill direction or in both directions. Plied yarns, such as two ply yarns, have been found to produce a fabric having better aesthetics.

The size of the spun yarns can vary depending upon the particular application and the desired result. For example, the size of the spun yarns can depend upon the desired overall fabric weight of the fabric, the type of garment being formed, and the like. In one aspect, when using single yarns, the yarn size can be 1/24, 1/26, 1/28/ 1/30, 1/32, 1/34, 1/36, 1/38, and/or 1/40. When using plied yarns, on the other hand, the size of the yarns can be 2/20, 2/22, 2/24, 2/26, 2/28, 2/30, 2/34, 2/38, 2/40, 2/44, 2/48, 2/52, 2/56, 2/60, 2/64, 2/68, 2/72, or 2/76 including all intervening sizes therebetween. The above sizes are based on worsted count (560 yds/lb).

The spun yarns produced according to the present disclosure containing wool fibers, cellulose fibers, and polyamide fibers, can extend only in the warp direction, only in the fill direction, or can extend in both the warp direction and the fill direction. Improved physical properties may be realized by having yarns made according to the present disclosure extend in both the warp direction and the fill direction. In fact, in one embodiment, greater than 90% by weight, such as greater than about 95% by weight, such as 100% by weight of the fabric can be formed from spun yarns made in accordance with the present disclosure. The spun yarns contained in the fabric can all be identical and can be made from the exact same intimate blend of fibers. Alternatively, different spun yarns can be incorporated into the fabric that are all made with different ratios or amounts of the wool fibers, the cellulose fibers and the polyamide fibers.

Wool fibers can be present in the spun yarns and in the fabric generally in an amount greater than about 20% by weight, such as in an amount greater than about 22% by weight, such as in an amount greater than about 25% by weight, such as in an amount greater than about 27% by weight, such as in an amount greater than about 30% by weight, such as in an amount greater than about 32% by weight, such as in an amount greater than about 35% by weight, such as in an amount greater than about 38% by weight. Wool fibers are generally contained in the spun yarn or the fabric in an amount less than about 43% by weight, such as in an amount less than about 40% by weight, such as in an amount less than about 35% by weight. Incorporating significant amounts of wool fibers into the fabric can provide numerous benefits and advantages. For example, wool is naturally fire resistant. In addition, wool is wrinkle resistant, retains its shape and is shrink resistant, is durable, and is tear resistant. Further, wool repels water drops and absorbs water vapor and is comfortable to wear in all seasons. Thus, in addition to providing protection against molten metal splashes and electrical arc flashes, wool can provide significant comfort to the wearer when incorporated into the fabric in the amounts described above.

Although any suitable wool fiber can be used in accordance with the present disclosure, in one aspect, wool fibers are incorporated into the fabric that have a relatively long length. For example, the wool fibers can have a length of greater than about 2.5 inches, such as greater than about 2.75 inches, such as greater than about 3 inches, such as greater than about 3.25 inches, such as greater than about 3.5 inches. The wool fibers generally have an average length of less than about 5 inches, such as less than about 4.5 inches, such as less than about 4 inches. The wool fibers can also have a relatively large diameter. For instance, the diameter of the wool fibers can be greater than about 18 microns, such as greater than about 19 microns, such as greater than about 20 microns, such as greater than about 21 microns. The average diameter of the wool fibers can generally be less than about 25 microns, such as less than about 23 microns, such as less than about 22 microns. Incorporating longer wool fibers and/or fibers having a relatively large diameter can provide challenges in forming the yarn and in weaving the yarns into the fabric. According to the present disclosure, however, it was discovered that the above described fibers can provide numerous advantages. The longer wool fibers, for instance, can significantly increase durability without sacrificing comfort.

In addition to wool fibers, the yarns of the present disclosure can also contain cellulose fibers, particularly flame resistant cellulose fibers. As used herein, flame resistant cellulose fibers refers to cellulose fibers that have been treated with a flame resistant composition or flame retardant. The inclusion of cellulose fibers in the fiber blend can make the resulting fabric softer, more breathable, and less expensive. Examples of flame resistant cellulose fibers that may be incorporated into the fabric include FR cotton, FR rayon, FR acetate, FR triacetate, FR lyocell, and mixtures thereof. In one particular embodiment, FR rayon fibers are incorporated into the fiber blend. FR rayon fibers are available from various different Sources. FR rayon fibers, for instance, are sold under the name LENZING® by Lenzing Fibers of Austria. LENZING FR fibers are viscous fibers that have been treated with a flame resistant composition. In one embodiment, the flame resistant rayon fibers are made by spinning reconstituted cellulose from beech trees. Such fibers are more water absorbent than cotton fibers. As described above, flame resistant cellulose fibers comprise fibers that have been treated with a flame resistant composition. The flame resistant composition can be incorporated into the fibers using various methods and techniques. For instance, the flame resistant composition can be incorporated into the fibers during spinning, can be coated on the fibers, or can be absorbed into the fibers. The flame resistant composition may contain, for instance, a phosphorus compound, a halogen compound, or any other suitable flame resistant agent.

When the yarns contain regenerated cellulose fibers, such as rayon fibers, the fibers can have a relatively long length that is comparable to the length of the wool fibers. For example, in one aspect, the flame resistant cellulose fibers can have an average fiber length of greater than about 0.5 inches, such as greater than about 1 inch, such as greater than about 1.5 inches, such as greater than about 2 inches, such as greater than about 2.5 inches, such as greater than about 3 inches, such as greater than about 3.5 inches, and generally less than about 6 inches, such as less than about 5.5 inches, such as less than about 5 inches, such as less than about 4.5 inches, such as less than about 4 inches.

The amount of flame resistant cellulose fibers present in the fiber blend can depend upon various different factors and the particular application. In one aspect, the flame resistant cellulose fibers can be present in the fiber blend or in the each yarn in an amount generally greater than about 45% by weight, such as in an amount greater than about 52% by weight, such as in an amount greater than about 55% by weight, such as in an amount greater than about 58% by weight, such as in an amount greater than about 60% by weight, and generally less than about 82% by weight, such as in an amount less than about 78% by weight, such as in an amount less than about 75% by weight, such as in an amount less than about 73% by weight, such as in an amount less than about 70% by weight, such as in an amount less than about 68% by weight, such as in an amount less than about 65% by weight. When the fabric is made exclusively from spun yarns containing wool, the flame resistant cellulose fibers, and a non-aromatic polyamide, the amount of flame resistant cellulose fibers present in the fabric is the same as described above with respect to the yarns. In other embodiments, the fabric can contain the flame resistant cellulose fibers in an amount of from about 30% to about 85% by weight, including all increments of 1% therebetween.

As described above, the fiber blend can also contain polyamide fibers, particularly non-aromatic polyamide fibers, in addition to the wool fibers and the flame resistant cellulose fibers. In one embodiment, the non-aromatic polyamide fibers incorporated into the fiber blend are nylon fibers. The non-aromatic polyamide fibers can increase the durability of the fabric, particularly abrasion resistance. The amount of non-aromatic polyamide fibers incorporated into the fiber blend can be controlled so as to maintain the desirable flame resistant, electric arc flash resistant, and molten metal resistant properties of the fabric while increasing the durability of the fabric. In general, the non-aromatic polyamide fibers can be present in the fiber blend and in the yarns in an amount greater than about 4% by weight, such as in an amount greater than about 6% by weight, such as in an amount greater than about 8% by weight, such as in an amount greater than about 10% by weight. The non-aromatic polyamide fibers are generally present in the fiber blend or yarn in an amount less than about 14% by weight, such as in an amount less than about 12% by weight, such as in an amount less than about 11% by weight.

The non-aromatic polyamide fibers generally comprise staple fibers having any suitable average fiber length. For instance, the fiber length can be anywhere from about 0.5 inches to about 6 inches, including all increments of 0.25 inches therebetween. In one aspect, relatively long fibers can be incorporated into the fiber blend. For instance, the average fiber length of the non-aromatic polyamide fibers can be greater than about 2 inches, such as greater than about 2.5 inches, such as greater than about 3 inches, such as greater than about 3.5 inches, and generally less than about 6 inches, such as less than about 5.5 inches, such as less than about 5 inches, such as less than about 4.5 inches, such as less than about 4 inches.

In one aspect, yarns made according to the present disclosure include an intimate fiber blend containing wool fibers in an amount of from about 22% to about 43% by weight, flame resistant cellulose fibers in an amount from about 52% to about 82% by weight, and non-aromatic polyamide fibers in an amount of from about 6% to about 14% by weight. Minor amounts of other fibers may be incorporated into the fiber blend, such as anti-static fibers. Other fibers are generally present in the yarn in an amount less than about 5% by weight, such as in an amount less than about 2% by weight.

Yarns formed from the fiber blend as described above can advantageously used in both the warp direction and the fill direction of a fabric made in accordance with the present disclosure. In one embodiment, the fabric can be made exclusively from spun yarns containing the fiber blend as described above. The yarns can all be identical or can have slight variations in the amount of the different fiber types. For instance, different yarns can be used to construct the fabric that contain different amounts of wool fibers, flame resistant cellulose fibers, and/or non-aromatic polyamide fibers.

In one aspect, spun yarns made in accordance with the present disclosure can account for about 50% to about 100% of the warp yarns used to produce the fabric, such as from about 70% to about 100%, such as from about 70% to about 90%, such as from about 80% to about 90%. Similarly, the spun yarns made in accordance with the present disclosure can account for from about 50% to about 100% of the fill yarns, such as from about 60% to about 100% of the fill yarns, such as from about 70% to about 100% of the fill yarns, such as from about 70% to about 90% of the fill yarns.

When producing a woven fabric in accordance with the present disclosure, the fabric can have any suitable weave. For instance, the fabric can have a plain weave, a twill weave, or a rip stop weave. In one embodiment, the fabric can also be made with a herringbone weave. Twill weaves that can be used include 1 by 2 twill weaves, 1 by 3 twill weaves, 1 by 4 twill weaves, 2 by 1 twill weaves, and the like.

The yarn density of fabrics made according to the present disclosure can vary depending upon the size and type of yarns used, the desired basis weight of the fabric, and other various factors.

In one aspect, the fabric can have greater than about 50 ends per inch, such as greater than about 70 ends per inch, such as greater than about 75 ends per inch, such as greater than about 85 ends per inch and generally less than about 100 end per inch, such as less than about 95 ends per inch, such as less than about 90 ends per inch. The fabric can have generally greater than about 30 picks per inch, such as greater than about 45 picks per inch, such as greater than about 50 picks per inch, such as greater than about 55 picks per inch, such as greater than about 60 picks per inch, and generally less than about 90 picks per inch, such as less than about 70 picks per inch, such as less than about 65 picks per inch, such as less than about 60 picks per inch.

In general, the fabric can have a basis weight of less than about 15 osy, such as less than about 14 osy, such as less than about 13 osy, such as less than about 12 osy. The basis weight is generally greater than about 8 osy, such as greater than about 9 osy, such as greater than about 10 osy. In one particular aspect, the basis weight of the fabric can be from about 10.5 osy to about 12 osy.

The fabrics constructed in accordance with the present disclosure can be used to construct numerous different types of products for use in various applications. In one embodiment, for instance, the fabrics can be used to produce apparel or garments for providing protection against hazards, such as molten metal splashes or electric arc flashes. As described above, in one aspect, the fabric can be constructed to provide dual protection against both molten metal splashes and electric arc flashes. Due to the combination of comfort, durability and protection, fabrics of the present disclosure are particularly well suited for producing protective apparel to be worn by workers in various environments, such as in industrial environments and manufacturing facilities. Garments or apparel made in accordance with the present disclosure can include shirts, pants, bib overalls, one-piece bodysuits, socks and other leg wear, gloves, scarves, hats, hoods, aprons, and the like For instance, referring to FIG. 1, one example of a coverall 10 made in accordance with the present disclosure is shown. The coverall 10 includes pants or leg coverings 12 and sleeves 14 all integrated into a single garment. The garments can include various pockets but also include flaps 16 for covering the pockets. The flaps ensure that molten metal splashes roll off the garment instead of entering the pockets.

It should be understood that the coveralls 10 as shown in FIG. 1 is merely one embodiment of a garment made in accordance with the present disclosure. In other embodiments, the garment can include separate pants or trousers that are worn with a shirt all made from the same fabric of the present disclosure.

The fabric of the present disclosure and/or apparel or garments made from the fabric can be dyed any desired color. For example, in one aspect, fabrics made according to the present disclosure can be piece dyed when producing garments. During piece dying, the woven fabric is fed through a dying process. Of particular advantage, fabrics can be piece dyed according to the present disclosure and have a uniform and consistent shade of color even though the fabric contains different types of yarns.

Alternatively, the yarns can first be dyed and then woven to form the fabric. For instance, fabrics can be made according to the present disclosure containing yarns that have been packaged dyed, which includes doped dyed yarns.

In still another aspect, the fibers incorporated into the fabric of the present disclosure can first be dyed prior to forming the yarns. The fibers, for instance, can be top dyed, which includes producer dyed fibers.

In addition, all of the above dying techniques can be combined together in forming fabrics. In one embodiment, the spun yarns can include fibers that have been top dyed and the woven fabric can be later piece dyed.

In one aspect, the fabric or garment can be dyed to shades that have high visibility in accordance with The American National Standard for High-Visibility Safety Apparel (ANSI/ISEA 107-2020). For example, the fabric can display a background color of fluorescent yellow-green, fluorescent orange-red or fluorescent red in accordance with the ANSI 107 standard. The colors can also be wash resistant and maintain the ANSI 107 standard after 5 laundry cycles or after 10 laundry cycles.

Fabrics made according to the present disclosure can have numerous beneficial properties and characteristics that provide protection against hazards, such as molten metal splashes and/or electrical arc flashes, but also provide comfort to the wearer. Fabrics made according to the present disclosure, for instant, can be durable, be resistant to pilling and be abrasion resistant all at relatively low bases weights for fabrics designed to protect wearers from molten metal splashes. Of particular advantage, fabrics made according to the present disclosure also have excellent dimensional stability and retain their mechanical properties even when wet.

Regarding protection against molten metal splashes, fabrics and garments made according to the present disclosure and tested according to ISO Test 11612, can have an E2 rating or better, such as an E3 rating or better when testing against molten iron and can have a D2 rating or better, such as a D3 rating or better when tested against molten aluminum. When tested against electrical arc flashes according to ASTM Test F1959 (ASTM Test 1959/F1959 M-14e1), the fabric or garments made from the fabric can demonstrate a rating of greater than about 8 cal/cm$^2$, such as greater than about 8.1 cal/cm$^2$, such as greater than about 8.2 cal/cm$^2$, and generally less than about 10 cal/cm$^2$. Achieving a rating of greater than 8 cal/cm$^2$ indicates that the fabric also meets the requirements of NFPA70E Class 2. Various standardized tests and protocols are also described in U.S. Patent Publication 2019/0242038, which is incorporated herein by reference. Of particular advantage, fabrics made according to the present disclosure can have the above properties while still having a basis weight of less than about 14 osy, such as less than about 13 osy, such as less than 12 osy.

Regarding protection against small flying molten metal particulate created by welding, fabrics and garments made according to the present disclosure and tested according to ISO Test 11611, can also have a rating of A1 with Class 2 (highest rating for this method). Of particular advantage, fabrics made according to the present disclosure can have the above properties while still having a basis weight of less than about 14 osy, such as less than about 13 osy, such as less than 12 osy.

When tested according to ASTM D5034, fabrics made according to the present disclosure can have a tensile strength in the warp direction of generally greater than about 125 lbs, such as greater than about 150 lbs, such as greater than about 175 lbs, such as greater than bout 190 lbs. The tensile strength in the warp direction is generally less than about 500 lbs, such as less than about 300 lbs. The tensile strength of the fabric in the fill direction, on the other hand, is generally greater than about 70 lbs, such as greater than about 80 lbs, such as greater than about 90 lbs, and generally less than about 400 lbs, such as less than about 200 lbs. When tested according to ASTM Test D1424, the fabric can have a tear strength in the warp direction of greater than about 3 lbs, such as greater than about 5 lbs, such as greater than about 7 lbs, and generally less than about 12 lbs. The tear strength in the fill direction, on the other hand, is generally greater than about 3 lbs, such as greater than about 3.5 lbs, such as greater than about 4 lbs, and generally less than about 20 lbs, such as less than about 10 lbs.

When tested for dimensional stability according to Test AATCC 135, (home launder), the fabric can display a stability value of less than about 5%, such as less than about 4%, such as less than about 3.8%, such as less than about 3.5% in the warp direction. In the fill direction, the dimensional stability value can also be less than about 5%, such as less than about 4%, such as less than about 3%, such as less than about 2.8%, such as less than about 2%.

The present disclosure may be better understood with reference to the following examples.

Example No. 1

A fabric was made in accordance with the present disclosure and tested for various properties. The fabric was made exclusively from spun yarns formed from an intimate blend of fibers. The blend of fibers contained 30% wool fibers, 60% flame resistant rayon fibers, and 10% nylon fibers. The wool fibers had an average fiber length of about 4 inches, the flame resistant rayon fibers had an average fiber length of about 3.5 inches and the nylon fibers had an average length of about 3.5 inches.

The fabric had the following properties and characteristics.

| Test Name and Reference Number | Preliminary Test Value |
|---|---|
| Weight (oz/sq yd) ASTM D3776 | 11.4 ounces |
| Weave | 2x1 twill |
| Width (inches) | 61.0 |
| Tensile Strength (pounds) ASTM D5304 | 197 warp 97 fill |
| Tear Strength (pounds) ASTM D1424 | 7.3 warp 4.3 fill |
| Seam Slippage ASTM D434 | 150 x 45 |
| Dimensional Stability, Home Launder AATCC 135 | 3.3% warp 1.9% fill |
| Colorfastness to Home Launder AATCC 61 (2A wash) | 4.0 |
| Colorfastness to Crock AATCC 8 | 5.0 dry 4.5 wet |
| Martindale Abrasion ASTM D4966 - 10,000 cycles | pass |
| Random Tumble Pilling ASTM D3512 | 5.0 |
| Arc Flash Protection Rating ASTM 1959/F1959M-14e1 | 8.3 cal/cm$^2$ |
| Molten Metal Protection ISO 11612 | D3/E3 |

As shown above, the fabric made according to the present disclosure had excellent electrical arc flash resistance and provided excellent molten metal splash resistance. These properties were obtained at a fabric weight of only about 11 osy.

Example No. 2

A fabric was made as described in Example No. 1 above and tested in accordance with ISO Test 11611:2015, which is a collection of tests that rates protection against small flying molten metal particulates that can be created during welding. The fabric was tested after 5 laundry cycles. Pretreatment of the fabric was conducted according to ISO Standard 6330:2012. The fabric received a rating of A1 in Class 2.

More particularly, the fabric was tested according to ISO Test 15025:2016, both Method A and Method B, according to ISO Test 9150:1988, according to ISO Test 6942:2002, Method B, and according to ISO Test 1149-2:1997.

The fabric, for instance, was tested for limited flame spread according to ISO Test 15025:2016 under Method A and Method B. The fabric was tested without laundering and after five laundry cycles. During the test, the fabric did not flame at the top or on either selvage, there was no after flame time, there was no after glow time, the fabric showed no signs of melting, no loose waste was produced, there is no evidence of inflammation of a filter paper detached from waste, and there was no hole formation. The same result was achieved on both the Method A Test and the Method B Test for the fabric prior to laundering and after five laundry cycles.

The fabric was also tested for small molten metal splashes according to ISO Test 9150:1988. The fabric was tested after five laundry cycles. Ten different fabric samples were tested and the results were average. The fabric displayed an average result of 32 number of drops. Thus, the fabric met the requirements of ISO Test 11611:2015, Class 2 which requires that the specimen not ignite after a minimum number of 25 drops of molten metal.

The fabric was also tested for radiant heat according to ISO Test 6942:2002, Method B after five laundry cycles. Three fabric samples were tested and the results were average. The fabric displayed a heat transfer index RHTI 12 (s) of 9.5 seconds and displayed a heat transfer index RHTI 24 (s) of 17.7 seconds and a TF of 40.7%. Thus, the fabric met the requirements of ISO Test 11611:2015 which, Class 2, which requires that the fabric display a heat transfer index RHTI 24 (s) of greater than or equal to 16 seconds.

The fabric was also tested for vertical resistance according to EN Test 1149-2:1997 after five laundry cycles. Five different fabric samples were tested and the results were average. The vertical resistance was $2.19\times10^7$ ohms. The above result also meets ISO Test Standard 11611:2015, Class 2 which requires a vertical electrical resistance of greater than 105 ohms under an applied potential of 100 plus or minus 5 volts.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A garment that is resistant to molten metals comprising;

a fabric shaped to cover at least a portion of a wearer's body, the fabric, when tested according to ISO Test 11612, displaying a rating of E3 or D3 and when tested according to ASTM Test F1959 displaying an arc flash value of greater than 8 cal/cm$^2$, the fabric comprising a woven fabric made from a plurality of yarns, the fabric comprising warp yarns and fill yarns, the warp yarns and fill yarns comprising a fiber blended yarn, the fiber blended yarn comprising a blend of fibers including:

wool fibers in an amount from about 22% to about 43% by weight of the fabric;

flame resistant cellulose fibers, the flame resistant cellulose fibers being present in the fabric in an amount from about 52% to about 82% by weight;

non-aromatic polyamide, the non-aromatic polyamide being present in an amount from about 6% to about 14% by weight; and wherein the fiber blended yarn comprises greater than 90% by weight of the fabric.

2. A garment as defined in claim 1, wherein the wool fibers comprise wool staple fibers having an average fiber length of greater than about 3 inches and less than about 5 inches.

3. A garment as defined in claim 1, wherein the yarns contained within the woven fabric are made from an intimate blend of the wool fibers, the flame resistant cellulose fibers, and the non-aromatic polyamide fibers.

4. A garment as defined in claim 1, wherein the woven fabric has a twill weave.

5. A garment as defined in claim 1, wherein the flame resistant cellulose fibers comprise cotton or rayon fibers pretreated with a fire resistant composition.

6. A garment as defined in claim 1, wherein the woven fabric contains about 25% to about 40% by weight wool fibers, from about 8% to about 12% by weight non-aromatic polyamide fibers, and from about 55% to about 65% by weight flame resistant cellulose fibers.

7. A garment as defined in claim 1, wherein the woven fabric has a basis weight of from about 8 osy to about 14 osy.

8. A garment as defined in claim 1, wherein the cellulose fibers comprise rayon staple fibers having an average fiber length of greater than about 3 inches and less than about 6 inches.

9. A garment as defined in claim 1, wherein the non-aromatic polyamide fibers comprise staple fibers having an average fiber length of greater than about 3 inches and less than about 6 inches.

10. A garment as defined in claim 1, wherein the yarns are two ply yarns.

11. A garment as defined in claim 1, wherein the fabric is made exclusively of the fiber blended yarn.

12. A garment as defined in claim 1, wherein the fabric comprises about 70 yarns per inch to about 110 yarns per inch in the warp direction and about 45 yarns per inch to about 85 yarns per inch in the fill direction.

13. A garment as defined in claim 1, wherein the garment comprises a shirt, overalls, trousers, or an apron.

14. A fabric material that is resistant to molten metals comprising a woven fabric made from a plurality of yarns, the fabric comprising warp yarns and fill yarns, the warp yarns and fill yarns comprising a fiber blended yarn, the fiber blended yarn comprising a blend of fibers including:

wool fibers in an amount from about 22% to about 43% by weight of the fabric, the wool fibers comprising wool staple fibers having an average fiber length of greater than about 3 inches and less than about 5 inches;

flame resistant cellulose fibers, the flame resistant cellulose fibers being present in the fabric in an amount from about 52% to about 82% by weight; and non-aromatic polyamide, the non-aromatic polyamide being present in an amount from about 6% to about 14% by weight.

15. A fabric material as defined in claim 14, wherein the flame resistant cellulose fibers comprise cotton or rayon fibers pretreated with a fire resistant composition.

16. A fabric material as defined in claim 14, wherein the woven fabric contains about 25% to about 40% by weight wool fibers, from about 8% to about 12% by weight non-aromatic polyamide fibers, and from about 55% to about 65% by weight flame resistant cellulose fibers.

17. A fabric material as defined in claim 14, wherein the cellulose fibers comprise rayon staple fibers having an average fiber length of greater than about 3 inches and less than about 6 inches and wherein the non-aromatic polyamide fibers comprise staple fibers having an average fiber length of greater than about 3 inches and less than about 6 inches.

18. A fabric material as defined in claim 14, wherein the yarns are two ply yarns.

19. A fabric material as defined in claim 14, wherein the fabric, when tested according to ISO Test 11612, displays a rating of E3 or D3 and when tested according to ASTM Test F1959 displays an arc flash value of greater than 8 cal/cm$^2$; and wherein the fabric, when tested according to ISO Test 11611, displays a rating of A1 under Class 2.

20. A garment that is resistant to molten metals comprising;

a fabric shaped to cover at least a portion of a wearer's body, the fabric comprising a woven fabric made from a plurality of yarns, the fabric comprising warp yarns and fill yarns, the warp yarns and fill yarns comprising an identical fiber blended yarn, the fiber blended yarn comprising a blend of fibers including:

wool fibers in an amount from about 22% to about 43% by weight of the fabric;

flame resistant cellulose fibers, the flame resistant cellulose fibers being present in the fabric in an amount from about 52% to about 82% by weight;

non-aromatic polyamide, the non-aromatic polyamide being present in an amount from about 6% to about 14% by weight; and wherein the fiber blended yarn comprises greater than 90% by weight of the fabric.

* * * * *